US006875074B1

(12) United States Patent
Morris et al.

(10) Patent No.: US 6,875,074 B1
(45) Date of Patent: Apr. 5, 2005

(54) FACIAL FEATURE ASSEMBLY

(76) Inventors: Eileen Morris, 8 Canyon Ridge, Irvine, CA (US) 92612; Renee Faggen, 1248 Gulph Creek Dr., Radnor, PA (US) 19087; Spencer Morris, 8 Canyon Ridge, Irvine, CA (US) 92612

( * ) Notice: Subject to any disclaimer, the term of this patent is extended or adjusted under 35 U.S.C. 154(b) by 0 days.

(21) Appl. No.: 10/803,505

(22) Filed: Mar. 18, 2004

(51) Int. Cl.[7] ..... A63H 3/12; A63H 3/02
(52) U.S. Cl. ..... 446/321; 446/369; 446/372
(58) Field of Search ..... 446/369, 370, 446/371, 372, 309–312, 390, 389, 393, 395, 321, 337, 342, 301

(56) References Cited

U.S. PATENT DOCUMENTS

| | | | | |
|---|---|---|---|---|
| 1,648,418 A | * | 11/1927 | Meiers | 446/343 |
| 2,148,888 A | * | 2/1939 | Wittmann | 446/342 |
| 2,195,127 A | * | 3/1940 | Brucker | 446/321 |
| 2,619,771 A | * | 12/1952 | Jones | 446/327 |
| 3,086,318 A | | 4/1963 | Brudney | |
| 3,125,826 A | | 3/1964 | Ostrander | |
| 3,132,770 A | | 5/1964 | Fried | |
| 3,462,876 A | | 8/1969 | Kirschenmann | |
| 3,699,707 A | | 10/1972 | Sapkus | |
| 3,811,220 A | * | 5/1974 | Glass et al. | 446/321 |
| 3,916,562 A | | 11/1975 | Burkhart | |
| 4,094,092 A | | 6/1978 | Bunin | |
| 4,255,894 A | | 3/1981 | Goldfarb et al. | |
| 4,413,442 A | * | 11/1983 | McSweeney | 446/73 |
| 4,560,363 A | * | 12/1985 | Garza et al. | 446/342 |
| 4,614,505 A | * | 9/1986 | Schneider et al. | 446/372 |
| 4,648,851 A | | 3/1987 | Rosenberg | |
| 4,776,823 A | * | 10/1988 | Hanlon | 446/321 |
| 4,795,398 A | * | 1/1989 | Wexler | 446/327 |
| 4,842,565 A | * | 6/1989 | VonPhilp, Sr. | 446/321 |
| 4,900,289 A | | 2/1990 | May et al. | |
| 5,178,574 A | | 1/1993 | Evoy | |
| 5,215,493 A | | 6/1993 | Zgrodek et al. | |
| 5,224,894 A | * | 7/1993 | Nelson et al. | 446/73 |
| 5,391,106 A | * | 2/1995 | Lidert, Jr. | 446/337 |
| 5,399,115 A | * | 3/1995 | Arad et al. | 446/342 |
| 5,501,627 A | * | 3/1996 | Ekstein | 446/175 |
| 5,649,848 A | * | 7/1997 | Clark | 446/321 |
| 5,782,669 A | * | 7/1998 | Hornsby et al. | 446/342 |
| 6,409,572 B1 | * | 6/2002 | Gwon | 446/339 |

FOREIGN PATENT DOCUMENTS

| | | |
|---|---|---|
| CA | 1223735 | 7/1987 |

* cited by examiner

*Primary Examiner*—Derris H. Banks
*Assistant Examiner*—Faye Francis
(74) *Attorney, Agent, or Firm*—Synnestvedt & Lechner LLP

(57) ABSTRACT

The present invention provides one or more movable members such as an eyelid, tongue, teeth, fangs or tusks for a stuffed toy or the like that are movable between a first position in which the one or more movable member is visible and a second position in which the one or more movable member is at least partially concealed whereby the demeanor or expression of the stuffed toy or the like may be changed.

16 Claims, 4 Drawing Sheets

FIG.2
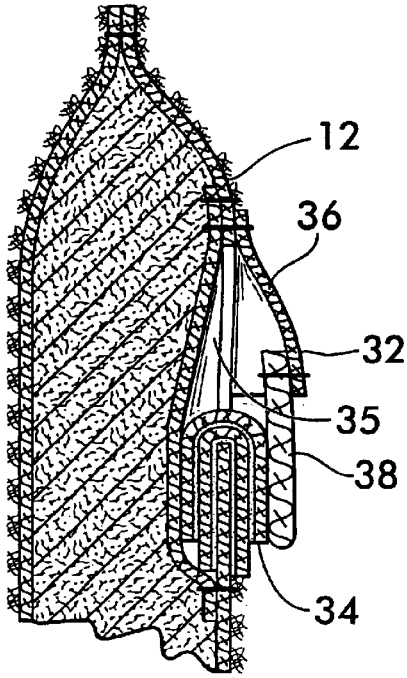
FIG.3
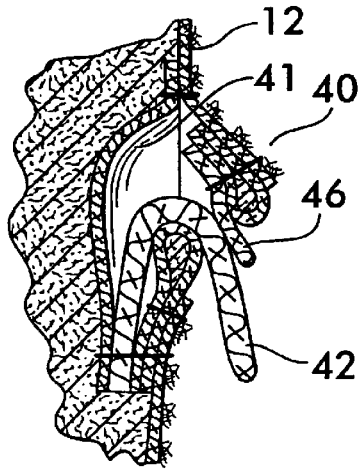
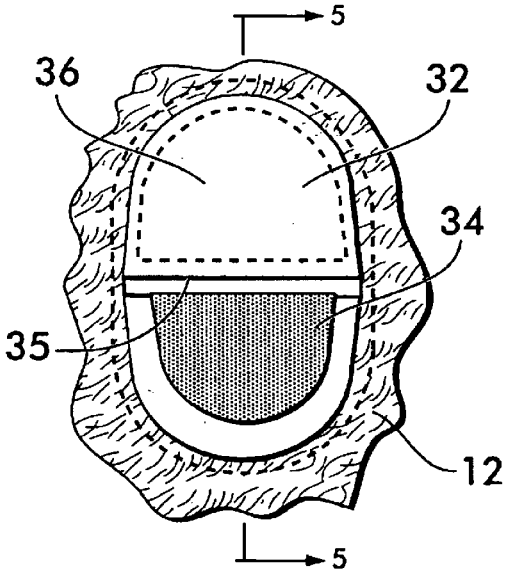
FIG.4
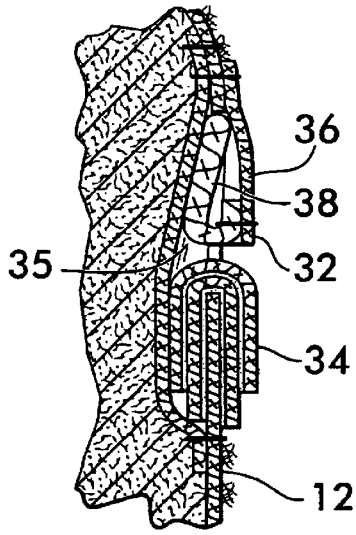
FIG.5

FIG.6
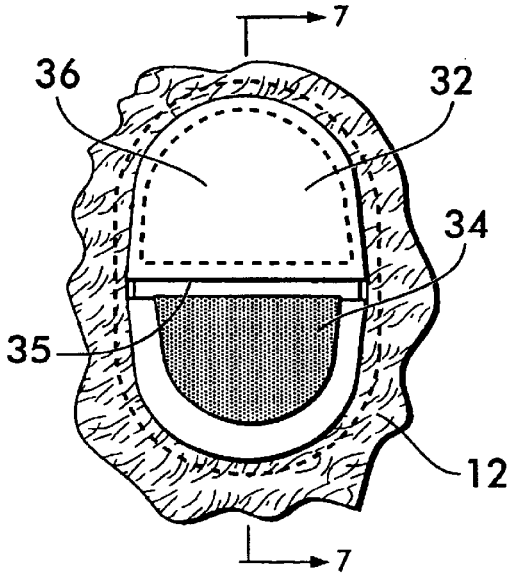
FIG.7
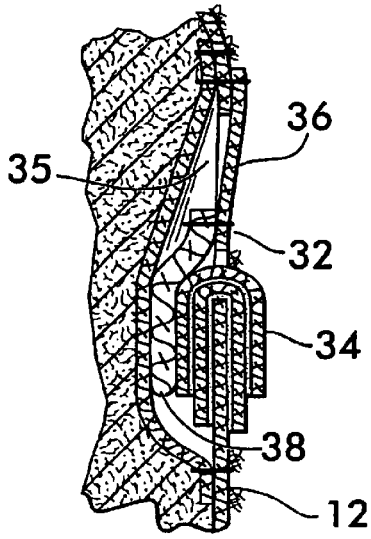
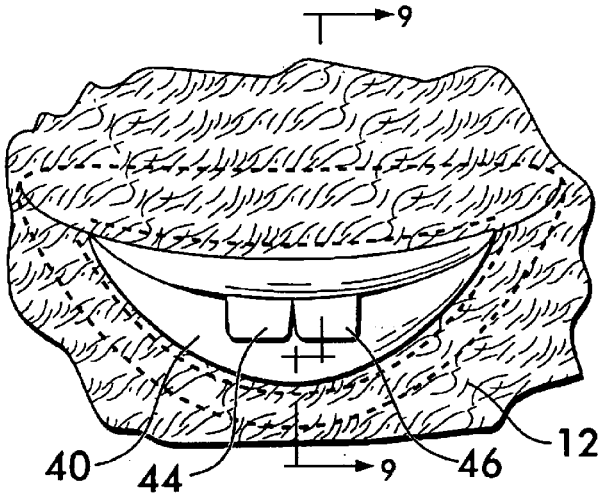
FIG.8
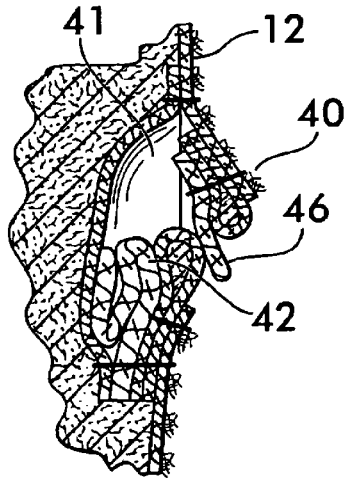
FIG.9

FIG.10
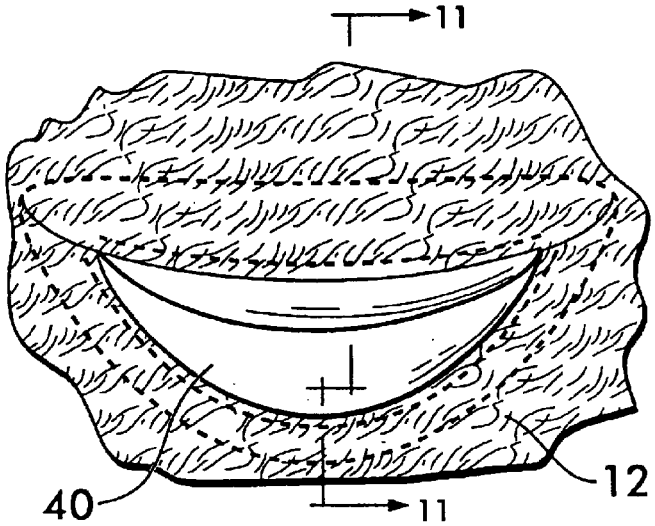
FIG.11
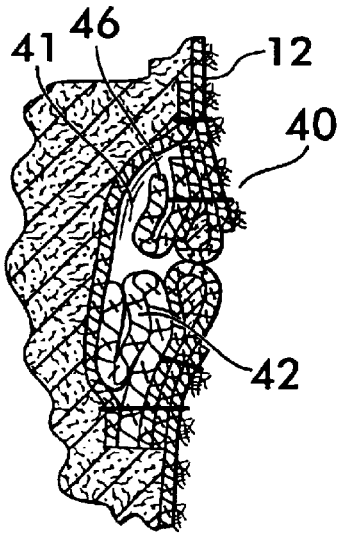
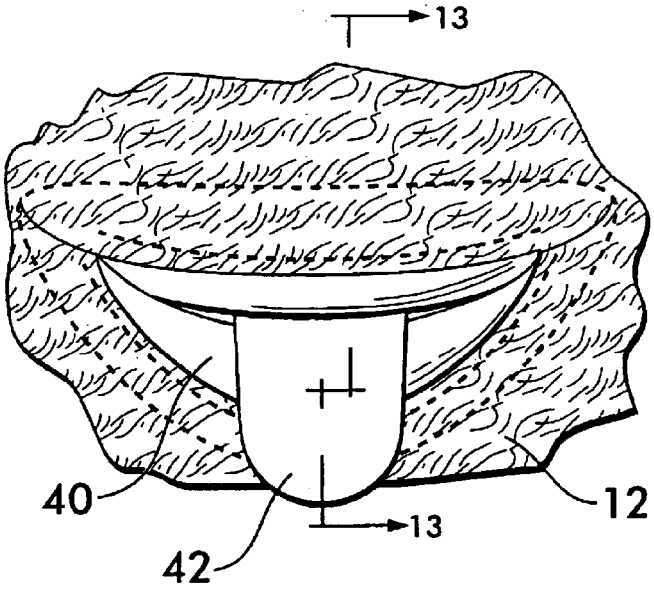
FIG.12
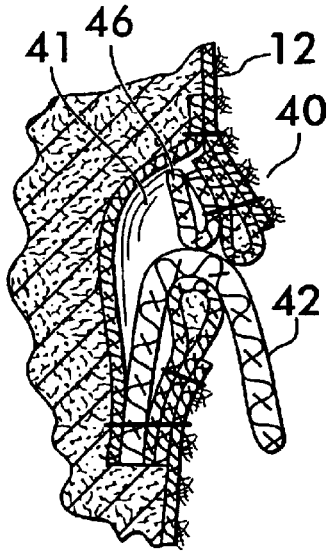
FIG.13

FACIAL FEATURE ASSEMBLY

BACKGROUND OF THE INVENTION

This invention relates to an article such as a stuffed toy having at least one movable member, more particularly one or more facial features, constructed of flexible material and movable to either of at least two alternate positions to alter the appearance of the one or more features of the stuffed toy.

Many toys such as dolls and other types of figurines have positionable or movable features, including limbs and/or facial features. U.S. Pat. No. 3,462,876 to Kirschenmann, U.S. Pat. No. 4,094,092 to Bunin, U.S. Pat. No. 3,125,826 to Ostrander, U.S. Pat. No. 3,916,562 to Burkhart, U.S. Pat. No. 3,699,707 to Sapkus, U.S. Pat. No. 5,399,115 to Arad et al., and U.S. Pat. No. 4,560,363 to Bjorklund et al. disclose examples of dolls or figurines which provide for changing facial expressions, including movable eyes and eyelids. Other examples of dolls with movable eye features are disclosed in U.S. Pat. No. 3,132,770 to Freed and U.S. Pat. No. 3,086,318 to Brudney wherein movable hemispherical shells or partial spheres, respectively, are used in the eye element to produce a movable eyelid effect.

Canadian Patent No. 1,223,735 discloses a stuffed toy changeable from an initial appearance in which various features are visible to a second appearance in which some of the features are precluded from view. The transformation is achieved by inverting an elastically expandable pocket integral with the covering of the toy so that the appendages and other features are contained within the pocket and the toy assumes a ball-like shape. U.S. Pat. No. 4,648,851 to Rosenberg teaches a stuffed animal with facial features that may be obscured by manipulating the loose outer skin about the face area.

Most stuffed toys do not have independently movable parts or changeable features. They are primarily soft and cuddly toys with permanently affixed features that are meant to be played with, embraced and loved by their owners. Although toys with moveable features are known in the art, there are drawbacks associated with the functioning of such devices. The dolls and figures disclosed in the preceding noted patents exhibit either expensive and complex internal mechanisms that may be inappropriate for all toys, particularly stuffed toys, or are capable of only limited transformation such as a complete inversion or movement of features from one visible position to another visible position.

SUMMARY OF THE INVENTION

In accordance with the present invention, there is provided a stuffed toy having at least one movable member, preferably one or more facial features, constructed of flexible material and movable to either of at least two alternate positions. In one position, the moveable member is visible and in the at least second position the moveable member is partially or completely concealed from view. In this manner, the moveable member is variously positionable to be either visible or concealed thus altering the appearance of the one or more features and the overall expression and demeanor of the stuffed toy in accordance with the imagination and desires of the user. The configurations possible are diverse and allow the user to exercise his or her creativity without limitation. The concealment of the moveable member in the at least second position is accomplished by the provision of a pocket positioned relative to the moveable member such that the moveable member is capable of being positioned partly or entirely within the pocket.

In one embodiment, the moveable member comprises an eyelid secured to the stuffed toy relative to an eye such that the eyelid may be positioned in a first position to cover the eye of the stuffed doll. In this manner, the eye of the stuffed toy has the appearance of being closed. The stuffed toy is further provided with a pocket positioned relative to the eyelid such that the eyelid may be positioned in a second position within the pocket. In this manner, the eye of the stuffed toy has the appearance of being open. In one embodiment, the pocket is formed by the attachment of the eye to the stuffed toy such that the pocket into which the eyelid may be positioned in a second position behind the eye. In another embodiment, the moveable member comprises an eyelid having at least a first portion and a second portion, and the attachment of the first portion of the eyelid to the stuffed toy forms a pocket into which the second portion of the eyelid may be positioned in a third position behind the first portion of the eyelid. In a further embodiment, the pocket is formed in the face of the stuffed toy such that the pocket into which the eyelid may be positioned in a fourth position within the face of the stuffed toy. One or more of these pocket configurations may be simultaneously present on a particular toy in accordance with the present invention.

In another embodiment, the moveable member comprises a tongue which is secured to the stuffed toy relative to a mouth on the stuffed toy such that the tongue may be positioned in a first position in which it is visible or alternatively in a second position in which the tongue is at least partially concealed. In this embodiment, the mouth of the stuffed toy forms a pocket positioned relative to the tongue such that the tongue may be positioned within the pocket and at least partially concealed from view. In another embodiment, the moveable member comprises one or more teeth, fangs or tusks, or combinations thereof, each of which are secured to the stuffed toy relative to the mouth such that at least one such moveable member may be positioned in a first position in which the movable member is visible or alternatively in a second position within the pocket and at least partially concealed from view. In a further embodiment, there are at least two moveable members comprising a tongue and at least one tooth, fang or tusk as described above. In yet another embodiment, there are a plurality of movable members including both eyelids and mouth features such as a tongue and or teeth, fangs or tusks.

BRIEF DESCRIPTION OF THE DRAWINGS

FIG. 2 is a cross-section view of the stuffed toy of FIG. 1 through an eye of the toy with the eyelid positioned in front of the eye.

FIG. 3 is a cross-section view of the stuffed toy of FIG. 1 through the mouth of the toy with the a tongue and teeth positioned to be visible.

FIG. 4 is a front elevation view of an eye of the toy with a lower portion of the eyelid concealed behind an upper portion of the eyelid.

FIG. 5 is a cross-section view of the eye of the toy as shown in FIG. 4.

FIG. 6 is a front elevation view of an eye of the toy with a lower portion of the eyelid concealed behind the eye.

FIG. 7 is a cross-section view of the eye of the toy as shown in FIG. 6.

FIG. 8 is a front elevation view the mouth with a tongue concealed within the mouth.

FIG. 9 is a cross-section view of the mouth of the toy as shown in FIG. 8.

FIG. 10 is a front elevation view the mouth with a tongue and teeth concealed within the mouth.

FIG. 11 is a cross-section view of the mouth of the toy as shown in FIG. 10.

FIG. 12 is a front elevation view the mouth with teeth concealed within the mouth.

FIG. 13 is a cross-section view of the mouth of the toy as shown in FIG. 12.

DETAILED DESCRIPTION OF INVENTION

Figure 1:
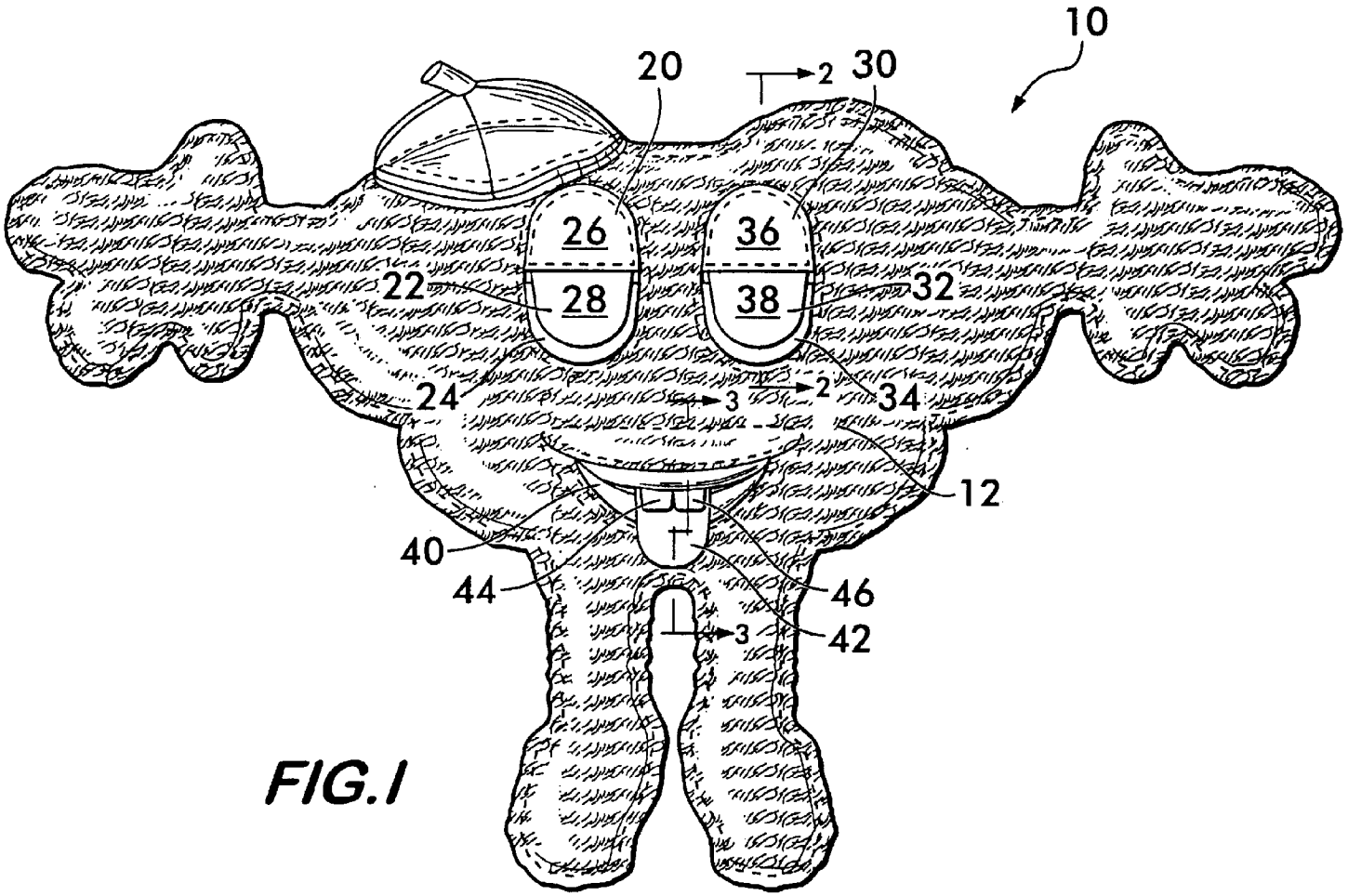
FIG. 1 is a front elevation view of a stuffed toy in accordance with one embodiment of the present invention having eyelids positioned in front of the eyes.

As used herein, the term stuffed toy is intended to mean any reality-based or fanciful figurine for amusing people, especially, although not exclusively, children. Such figurines have been and are made to represent or exhibit all manner of animal, human and imaginative forms. Commonly, such stuffed toys are caricatures that typically include at least some recognizably human or animal features, such as a face having eyes and a mouth. The term stuffed toy is particularly intended to encompass "plush" toys, i.e., those having a fabric exterior defining an interior space which is then filled with a fill material.

The movable members of the present invention may comprise a unitary structure or an assemblage of discrete elements combined to form a feature, such as a facial feature, or a combination of features, that are simple, inexpensive and safe elements for a stuffed toy or the like.

With reference to FIG. 1, there is shown an exemplary embodiment in which the stuffed toy 10 is in the form of a cloud having eye features 20 and 30, and a mouth 40, positioned on the face 12 of the stuffed toy 10. While the eye features 20 and 30 as shown in FIG. 1 comprise a fabric material and are attached to the face 12 of the stuffed toy 10 by stitching, the eye features may alternatively comprise any suitable fabric-like or other flexible material and may be fastened to the face 12 by any conventional fastening means such as buttons, snaps, zippers, adhesives, application of heat, or other fastening assemblies such as, for example, hook and loop assemblies such as are sold under the Velcro trademark.

Eye features 20 and 30 as shown in FIG. 1 each comprise an eyelid 22 and 32, and an eye 24 and 34. Eyelids 22 and 32 are positioned relative to the eyes 24 and 34 such that the eyelids 22 and 32 may be positioned in a first position such that the eyelids 22 and 32 are placed over the eyes 24 and 34 to create the appearance that the eyes 24 and 34 of the stuffed doll are closed. Eyelids 22 and 32 are attached to the face 12 of the stuffed toy such that each is independently capable of assuming at least a second position in which one or both may be positioned in at least a second position such that they are at least partially concealed from view. Eye features 20 and 30 may further comprise eyebrows, eyelashes, other features, and combinations thereof (not shown) to further enhance the appearance of the stuffed toy. FIG. 2 shows a representative eye feature as shown in FIG. 1 in cross-section.

In the embodiment shown in FIG. 4 in which a representative eye feature as shown in FIG. 1 is shown, eyelid 32 comprises an upper portion 36 and a lower portion 38 in which the upper portion 36 is attached to the face 12 of the stuffed toy and the lower portion 38 is movable to at least two positions. In this embodiment, the upper portion 36 is attached to the face 12 of the stuffed toy in such a manner that pocket 35 is formed between the upper portion 36 and the face 12. The lower portion 38 of the eyelid 32 is thus capable of being positioned either in a first position over the eye or in a second position within the pocket 35 formed by the attachment of the upper portion 36 of the eyelid 32 and the face 12. In this manner, some or all of the lower portion 38 of the eyelid 32 is concealed from view thereby creating the appearance that the eye 34 of the stuffed toy is open as shown in FIG. 4. FIG. 5 shows the representative eye feature as shown in FIG. 4 in cross-section.

In another embodiment as shown in FIG. 6, the eye 34 is attached to the face 12 of the stuffed toy 10 in such a manner that pocket 37 is formed between the eye 34 and the face 12. In this embodiment, the eyelid 32 is positioned relative to the eye 34 such that at least the lower portion 38 of the eyelid 32 is capable of being positioned in a third position within the pocket 37 formed by the attachment of the eye 34 and the face 12. In this manner, some or all of the eyelid 32 is concealed from view thereby creating the appearance that the eye 34 of the stuffed toy is open as shown in FIG. 6. The stuffed toy as shown in FIG. 6 may have an eyelid 32 that is also capable of being positioned as shown in FIG. 4 and described above. Similarly, the stuffed toy as shown in FIG. 4 may have an eyelid 32 that is also capable of being positioned as shown in FIG. 6. In yet a further embodiment (not shown), pockets are formed within the face relative to the eyelids such that at least a portion of the eyelids 22 and 32 as shown in FIG. 1 are capable of being positioned in a fourth position within the pockets formed within the face 12. In this manner, at least a portion of the eyelids 22 and 32 are concealed from view thereby creating the appearance that the eyes 24 and 34 of the stuffed toy are open. FIG. 7 shows a representative eye feature as shown in FIG. 6 in cross-section.

With reference to FIGS. 1 and 3, there is shown a stuffed toy 10 in the form of a cloud having a mouth 40 comprising a tongue 42 and teeth 44 and 46. While the tongue 42 and teeth 44 and 46 as shown in FIGS. 1 and 3 comprise a fabric material and are attached to the face 12 of the stuffed toy by stitching, these features may alternatively comprise any suitable fabric-like or other flexible material and may be fastened to the face 12 by any conventional fastening means such as for example buttons, snaps, zippers, adhesives, application of heat, or other fastening assemblies such as, for example, hook and loop assemblies such as are sold under the Velcro trademark. The tongue 42 and teeth 44 and 46 are positioned relative to the mouth 40 such that the one or more of the tongue 42 and teeth 44 and 46 may be positioned in a first position such that they are visible to create the appearance of either a protruding tongue or bared teeth or both.

FIGS. 8 and 9 show that the tongue 42 is attached to the mouth 40 such that it is capable of assuming at least a second position in which at least a portion of the tongue 42 is concealed from view. In this embodiment, the mouth 40 defines a pocket 41 which is positioned relative to the tongue 42 such that at least a portion of the tongue may be positioned within the pocket. FIGS. 10 and 11 show an embodiment of the stuffed toy in which the mouth 40 comprises a tongue 42 and teeth 44 and 46 attached to the mouth 40 such that each is independently capable of assuming at least a second position in pocket 41 in which at least one such feature is at least partially concealed from view. FIGS. 12 and 13 show an embodiment of the stuffed toy in which the mouth 40 comprises teeth 44 and 46 attached to the mouth 40 such that each is independently capable of assuming at least a second position in pocket 41 in which at least one such tooth is at least partially concealed from view.

Mouth 40 may further or alternatively comprise fangs, tusks, or other such mouth structures, and combinations thereof (not shown), that also may be capable of assuming at least two alternate positions in which the structure or structures are visible in one position and at least partially concealed in pocket 41 in a second position.

The preferred material for forming the movable features of the present invention is a flexible fabric or fabric-like material that is durable and capable of being securely attached to the stuffed toy. The materials for forming the movable elements of the present invention may be selected from appropriate materials or mixtures of materials, and thickness, texture, profile patterns and color can be selected as desired, as can the size of the toy and movable features. In preferred embodiments, the movable elements comprise a washable fabric that is soft to the touch such as, for example, cotton, wool, felt, velvet, velveteen, velour, chenille, or the like.

Any suitable fabric or fabric-like material, synthetic, natural or a mixture thereof, may used in forming the exterior surface of the stuffed toy of the present invention. Preferably, the exterior surface comprises a washable fabric that is soft to the touch such as, for example, cotton, wool, felt, velvet, velveteen, velour, chenille, or the like.

The fill material of the stuffed toy preferably comprises a soft, compressible material such as one or more natural or synthetic foams, gels or fibers. Alternatively, the fill material may comprise a plurality of either hard or soft units or mixtures thereof such as, for example, beads, beans, pellets, sand, gelatin capsules or the like.

Although a stuffed toy is depicted in the accompanying figures, it should be understood that the combination of one or more moveable members and associated pockets for the at least partial concealment of such movable members could be adapted for use with any doll or figure. The toys of the present invention may also be provided with other ornamentation, coloration, clothes or accessories which can be permanently or removably affixed to the toy to enhance the entertainment value of the product for the user.

What is claimed is:

1. A stuffed toy comprising a face, and at least one eve and at least one eyelid constructed of fabric material both attached to the face, and a pocket positioned proximate to the eyelid wherein the eyelid is capable of being positioned in a first position in which the eyelid is over the eye or alternatively in a second position in which the eyelid is at least partially concealed within the pocket.

2. The stuffed toy of claim 1 wherein the pocket is formed by the attachment of a first portion of the eyelid to the face, and a second portion of the eyelid is capable of being positioned at least partially within the pocket.

3. The stuffed toy of claim 1 wherein the pocket is formed by the attachment of the eye to the face, and a portion of the eyelid is capable of being positioned at least partially within the pocket.

4. The stuffed toy of claim 1 wherein the pocket is formed within the face, and a portion of the eyelid is capable of being positioned at least partially within the pocket.

5. The stuffed toy of claim 1 further comprising a mouth and a tongue both attached to the face, and a pocket positioned within the mouth wherein the tongue is capable of being positioned in a first position protruding from the mouth or alternatively in a second position in which the tongue is at least partially concealed within the pocket.

6. The stuffed toy of claim 5 further comprising at least one tooth attached to the face wherein the at least one tooth is capable of being positioned in a first position protruding from the mouth or alternatively in a second position in which the at least one tooth is at least partially concealed within the pocket.

7. The stuffed toy of claim 6 wherein the pocket is formed by the attachment of a first portion of the eyelid to the face, and a second portion of the eyelid is capable of being positioned at least partially within the pocket.

8. The stuffed toy of claim 6 wherein the pocket is formed by the attachment of the eye to the face, and a portion of the eyelid is capable of being positioned at least partially within the pocket.

9. The stuffed toy of claim 6 wherein the pocket is formed within the face, and a portion of the eyelid is capable of being positioned at least partially within the pocket.

10. The stuffed toy of claim 5 wherein the pocket is formed by the attachment of a first portion of the eyelid to the face, and a second portion of the eyelid is capable of being positioned at least partially within the pocket.

11. The stuffed toy of claim 5 wherein the pocket is formed by the attachment of the eye to the face, and a portion of the eyelid is capable of being positioned at least partially within the pocket.

12. The stuffed toy of claim 5 wherein the pocket is formed within the face, and a portion of the eyelid is capable of being positioned at least partially within the pocket.

13. The stuffed toy of claim 1 further comprising a mouth and at least one tooth both attached to the face, and a pocket positioned within the mouth wherein the at least one tooth is capable of being positioned in a first position protruding from the mouth or alternatively in a second position in which the at least one tooth is at least partially concealed within the pocket.

14. The stuffed toy of claim 13 wherein the pocket is formed by the attachment of a first portion of the eyelid to the face, and a second portion of the eyelid is capable of being positioned at least partially within the pocket.

15. The stuffed toy of claim 13 wherein the pocket is formed by the attachment of the eye to the face, and a portion of the eyelid is capable of being positioned at least partially within the pocket.

16. The stuffed toy of claim 13 wherein the pocket is formed within the face, and a portion of the eyelid is capable of being positioned at least partially within the pocket.

* * * * *